US009444169B2

(12) United States Patent
Gates

(10) Patent No.: US 9,444,169 B2
(45) Date of Patent: Sep. 13, 2016

(54) CONTACTS WITH RETRACTABLE DRIVE PINS

(71) Applicant: Joshua Paul Gates, Kinston, NC (US)

(72) Inventor: Joshua Paul Gates, Kinston, NC (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/601,986

(22) Filed: Jan. 21, 2015

(65) Prior Publication Data

US 2016/0211603 A1 Jul. 21, 2016

(51) Int. Cl.
*H01R 13/426* (2006.01)
*H01R 13/22* (2006.01)
*H01R 4/18* (2006.01)

(52) U.S. Cl.
CPC ..... *H01R 13/22* (2013.01); *H01R 4/18* (2013.01)

(58) Field of Classification Search
CPC ..... H01R 13/434
USPC ..... 439/90, 903, 745, 738
See application file for complete search history.

(56) References Cited

U.S. PATENT DOCUMENTS 1,291,460 A * 1/1919 Finley ..... H01R 4/60 174/84 S
1,456,516 A * 5/1923 Riecken ..... H01R 24/58 244/65
1,536,082 A 5/1925 Douglas
2,039,996 A 5/1936 Hessel
2,115,324 A * 4/1938 Bardwell ..... H01R 13/213 439/732
2,410,618 A * 11/1946 Zelov ..... H01R 24/22 174/51
2,469,397 A * 5/1949 Mezek ..... H01R 13/514 439/687
2,779,929 A * 1/1957 Sesny ..... H01R 13/428 439/745
2,907,973 A * 10/1959 Stevens, Jr. ..... H01R 13/6278 285/921
2,992,403 A * 7/1961 Hawk ..... H01R 9/091 439/743
3,031,639 A * 4/1962 Majewski ..... H01R 13/434 439/740
3,052,867 A * 9/1962 Rogoff ..... H01R 13/18 439/745
3,343,852 A 9/1967 Blight et al.
3,681,742 A * 8/1972 Newman ..... H01R 13/213 439/744
3,810,072 A * 5/1974 Moore ..... H01R 13/432 439/336
3,876,234 A * 4/1975 Harms ..... A61M 39/10 285/332

(Continued)

FOREIGN PATENT DOCUMENTS

JP 1145746 2/1999

*Primary Examiner* — Neil Abrams
(74) *Attorney, Agent, or Firm* — King & Spalding LLP

(57) ABSTRACT

An insertable electrical contact is disclosed herein. The insertable electrical contact can include a body having a connector end, a conductor receiver end, and a middle portion disposed between the connector end and the conductor receiver end. The insertable electrical contact can also include at least one retractable drive pin disposed in the body, where the at least one retractable drive pin has a normal position and a retracted position, where the at least one retractable drive pin is disposed within the body when in the retracted position, and where the at least one retractable drive pin is protrudes from an outer surface of the body when in the normal position. The at least one retractable drive pin can be in the retracted position as the body is inserted into a connector sleeve and can revert to the normal position when the body is positioned within the connector sleeve.

20 Claims, 7 Drawing Sheets

(56) References Cited

U.S. PATENT DOCUMENTS 3,885,849 A * 5/1975 Bailey ..... H01R 13/506 439/320
3,960,428 A 6/1976 Naus et al.
4,413,875 A * 11/1983 Mattingly ..... H01R 13/508 439/660
4,775,334 A * 10/1988 Jarry ..... H01R 4/01 439/745
4,985,002 A 1/1991 Maisch et al.
5,427,549 A * 6/1995 Smith ..... H01R 13/506 439/101
5,743,763 A * 4/1998 Giovanni ..... H01R 13/506 439/598
6,042,428 A * 3/2000 Espiritu ..... H01R 13/506 439/686
6,309,258 B1 10/2001 Measley
6,796,850 B2 9/2004 Matsui et al.
7,029,303 B2 * 4/2006 Bordeau ..... H01R 13/187 439/286
7,077,681 B2 * 7/2006 Behoo ..... H01R 13/213 439/333
7,695,333 B2 * 4/2010 Strickland, Jr. .... H01R 13/5221 439/737
7,892,047 B2 * 2/2011 Strickland, Jr. .... H01R 13/6297 439/738
8,011,942 B2 9/2011 Ohmori et al.
2014/0073163 A1 3/2014 Kojima et al.

* cited by examiner

CONTACTS WITH RETRACTABLE DRIVE PINS

TECHNICAL FIELD

Embodiments described herein relate generally to electrical connectors, and more particularly to insertable contacts for electrical connectors.

BACKGROUND

For many electrical applications, electrical connectors are used. Some electrical connectors are assembled in the field. For example, a user may insert a contact, made of electrically conductive material, into a sleeve. Once this is done, an electrical conductor can be coupled to the connector. When the contact is inserted into the sleeve of the connector, an amount of force is required. This force can be significant because of the configuration (e.g., shape, size, features) of the contact relative to the sleeve. When the force required is high, damage can occur to the contact and/or sleeve. In addition, a user assembling the connector can be subject to safety hazards because of the awkwardness of handling these components.

SUMMARY

In general, in one aspect, the disclosure relates to an insertable electrical contact. The insertable electrical contact can include a body having a connector end, a conductor receiver end, and a middle portion disposed between the connector end and the conductor receiver end. The insertable electrical contact can also include at least one retractable drive pin disposed in the body, where the at least one retractable drive pin has a normal position and a retracted position, where the at least one retractable drive pin is disposed within the body when in the retracted position, and where the at least one retractable drive pin protrudes from an outer surface of the body when in the normal position. The at least one retractable drive pin can be in the retracted position as the body is inserted into a connector sleeve, and the at least one retractable drive pin can revert to the normal position when the body is positioned within the connector sleeve.

In another aspect, the disclosure can generally relate to an electrical connector. The electrical connector can include a connector sleeve having a wall that forms a cavity. The electrical connector can also include an insertable electrical contact forced into the cavity of the connector sleeve. The insertable electrical contact of the electrical connector can include a body having a connector end, a conductor receiver end, and a middle portion disposed between the connector end and the conductor receiver end. The insertable electrical contact of the electrical connector can also include at least one retractable drive pin disposed in the body, where the at least one retractable drive pin has a normal position and a retracted position, where the at least one retractable drive pin is disposed within the body when in the retracted position, and where the at least one retractable drive pin protrudes from an outer surface of the body when in the normal position. The at least one retractable drive pin can be in the retracted position as the body is inserted into the cavity of the connector sleeve, and the at least one retractable drive pin can revert to the normal position when the body is positioned within the cavity of the connector sleeve.

These and other aspects, objects, features, and embodiments will be apparent from the following description and the appended claims.

BRIEF DESCRIPTION OF THE DRAWINGS

The drawings illustrate only example embodiments of contacts of electrical connectors with retractable drive pins and are therefore not to be considered limiting of its scope, as contacts of electrical connectors with retractable drive pins may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
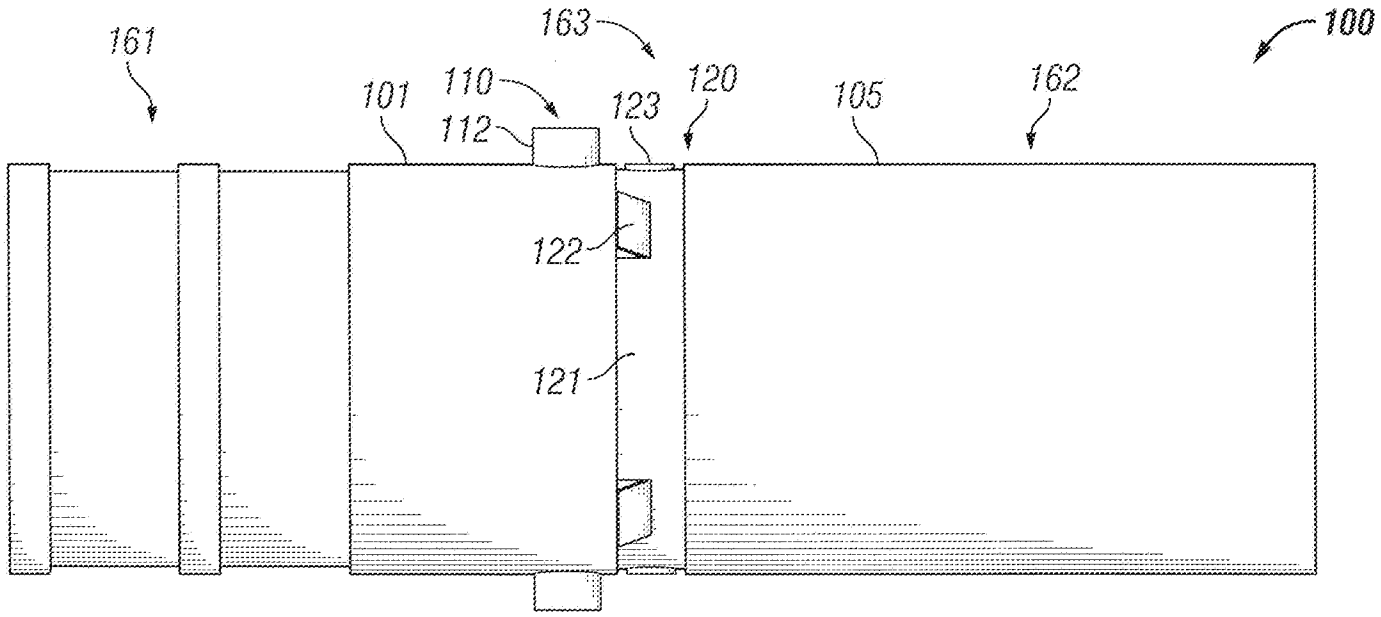
FIG. 1 (Prior Art)
FIG. 1 shows a side view of a contact of an electrical connector in accordance with embodiments known in the art.

The example embodiments discussed herein are directed to systems, methods, and devices for connectors of electrical connectors with retractable drive pins. Certain example embodiments provide a number of benefits. Examples of such benefits include, but are not limited to, increased ease of assembly of an electrical connector, maintained integrity of the contact and sleeve, and reduced risk of injury to the person assembling an electrical connector.

While the example embodiments described herein are directed to electrical connectors that are assembled in the field, example embodiments can be assembled as part of the manufacturing process or in some other setting rather than in the field. Therefore, example embodiments described herein should not be considered limited to assembly at any particular location and/or by any particular person.

The electrical connectors (or components thereof, such as the connector) described herein can be made of one or more of a number of suitable materials to allow the contact to meet certain standards and/or regulations while also maintaining durability in light of the one or more conditions under which the example connectors can be exposed. Examples of such materials can include, but are not limited to, aluminum, stainless steel, fiberglass, glass, plastic, and rubber.

As discussed above, example electrical connectors can be subject to meeting certain standards and/or requirements. For example, the National Electrical Manufacturers Association (NEMA) establishes, maintains, and publishes ratings and requirements for electrical enclosures, which can include electrical connectors. For example, a NEMA 3 enclosure is an enclosure that is "constructed for either indoor or outdoor use to provide a degree of protection to personnel against access to hazardous parts; to provide a degree of protection of the equipment inside the enclosure against ingress of solid foreign objects (falling dirt and windblown dust); to provide a degree of protection with respect to harmful effects on the equipment due to the ingress of water (rain, sleet, snow); and that will be undamaged by the external formation of ice on the enclosure."

Any components (e.g., drive pins, retaining ring) of example electrical connectors, or portions thereof, described herein can be made from a single piece (as from a mold, injection mold, die cast, or extrusion process). In addition, or in the alternative, a component (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person that interacts with an electrical connector. Examples of a user may include, but are not limited to, an engineer, an electrician, a maintenance technician, a mechanic, an operator, a consultant, a contractor, and a manufacturer's representative. Further, as used herein, the term "diameter" is used to describe a dimension of a component of an electrical connector. A diameter can be used to describe a dimension for a circular component, an oval-shaped component, a square-shaped component, a rectangular component, a hexagonally-shaped component, or any other shape for a component. For example, a diameter can be used to describe a dimension from one side of an electrical contact body to another side of the an electrical contact body, regardless of the shape of the electrical contact body.

Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

Example embodiments of electrical connectors will be described more fully hereinafter with reference to the accompanying drawings, in which example embodiments of electrical connectors are shown. Electrical connectors may, however, be embodied in many different forms and should not be construed as limited to the example embodiments set forth herein. Rather, these example embodiments are provided so that this disclosure will be thorough and complete, and will fully convey the scope of electrical connectors to those of ordinary skill in the art. Like, but not necessarily the same, elements (also sometimes called components) in the various figures are denoted by like reference numerals for consistency.

Terms such as "first," "second," "end," "middle," "width," "length," "bottom," "inner," "outer," "proximal", and "distal" are used merely to distinguish one component (or part of a component or state of a component) from another. Such terms are not meant to denote a preference or a particular orientation, and are not meant to limit embodiments of contacts of electrical connectors with retractable drive pins. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
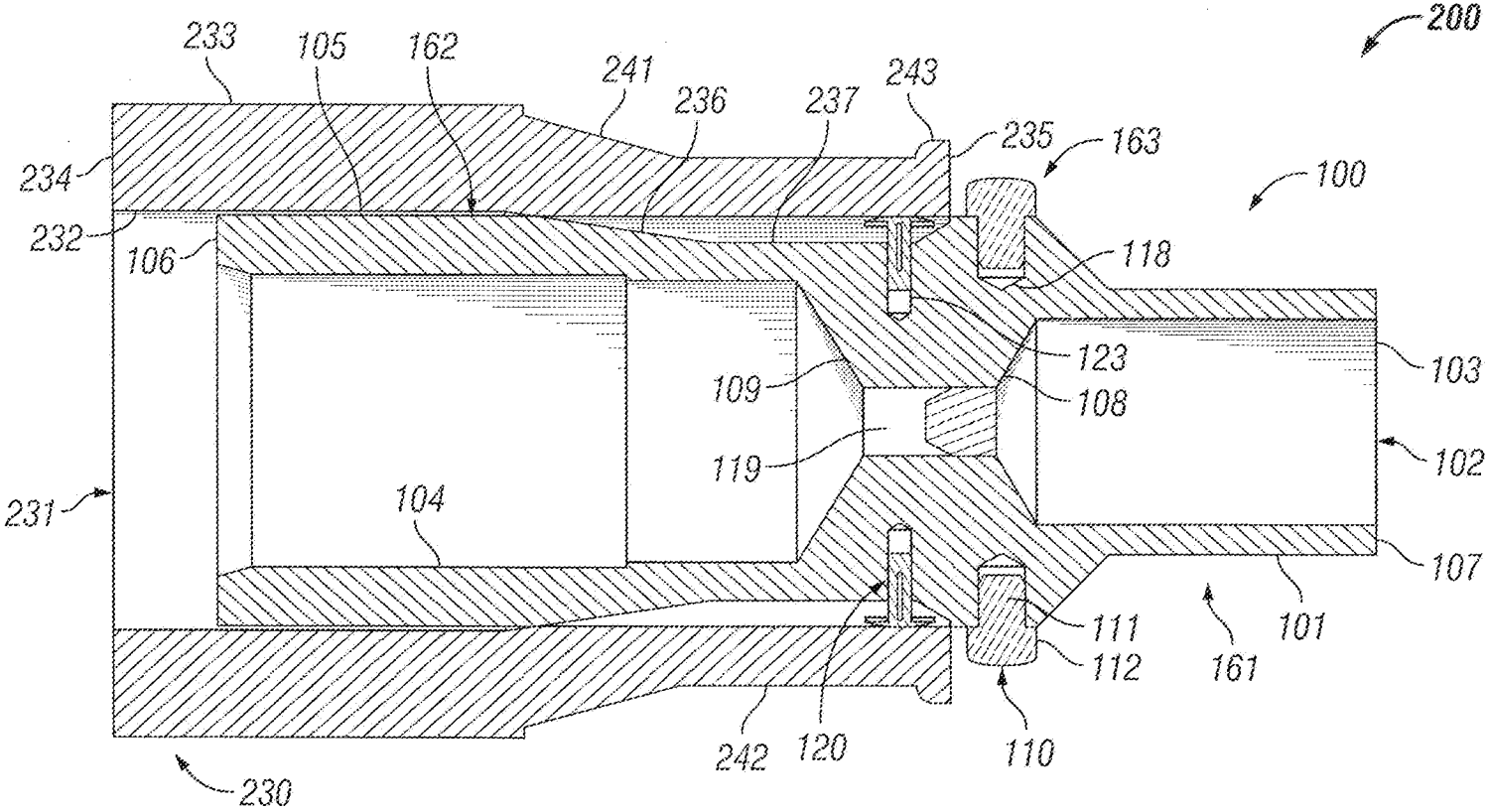
FIG. 2 (Prior Art)
FIG. 2 shows an electrical connector in accordance with embodiments known in the art.

FIG. 1 shows a side view of an electrical contact 100 in accordance with embodiments currently used in the art. FIG. 2 shows a partial cross-sectional side view of a disassembled electrical connector 200, where the electrical contact 100 is beginning to be inserted into a portion of the connector sleeve 230, in accordance with embodiments currently used in the art. Referring to FIGS. 1 and 2, the electrical contact 100 includes a body that has a conductor receiver end 161, a connector end 162, and a middle portion 163 that is disposed between the conductor receiver end 161 and the connector end 162. The electrical contact 100 also includes a pair of drive pins 110 that are about to be inserted into the connector sleeve 230.

The conductor receiver end 161 of the electrical contact 100 is substantially tubular with a shape, when viewed from the end 107, that is substantially circular. The conductor receiver end 161 of the electrical contact 100 has an outer surface 101, an inner surface 103, the end surface 107, and a transitional inner surface 108. The inner surface 103 and the transitional inner surface 108 in this case form a cavity 102 that traverses the length of the conductor receiver end 161, as well as the length of the electrical contact 100.

The connector end 162 of the electrical contact 100 is made of one or more electrically conductive materials (e.g., copper, aluminum). The cavity 102 is configured to receive a connector portion so that the inner surface 104 and, in some cases, the transitional inner surface 109, can couple to the connector portion. For example, in this case, the connector end 162 has a female configuration (by virtue, for example, of the cavity 102), and so the connector end 162 is configured to receive a conductive pin of another connector.

The conductor receiver end 161 of the electrical contact 100 is substantially tubular with a shape, when viewed from the end 107, that is substantially circular. The conductor receiver end 161 of the electrical contact 100 has an outer surface 101, an inner surface 103, the end surface 107, and a transitional inner surface 108. The inner surface 103 and the transitional inner surface 108 in this case form the cavity 102 that traverses the length of the conductor receiver end 161. The conductor receiver end 161 of the electrical contact 100 is made of an electrically conductive material, and the cavity 102 is configured to receive an electrical conductor. When the electrical conductor is inserted into the cavity 102, a user can crimp or otherwise deform the conductor receiver end 161 to force a substantially permanent contact (coupling) between the conductor receiver end 161 and the electrical conductor. Crimping and/or otherwise deforming the conductor receiver end 161 usually occurs before the electrical contact 100 is inserted into the connector sleeve 230.

The pair of drive pins 110 and the retaining ring 120 are disposed on the outer surface of the middle portion 163 of the electrical contact 100. Each of the drive pins 110 have a head 112 that protrudes from the outer surface of the middle portion 163 and a shaft 111 that is fixedly disposed within an aperture 118 in the middle portion 163. In other words, the drive pins 110 are always protruding from the outer surface of the middle portion 163. The two drive pins 110 are disposed on substantially opposite sides (in this case, top and bottom) of the middle portion 163. The drive pins 110 are designed to help prevent the electrical contact 100 from being inserted beyond a certain point within the connector sleeve 230, described below.

The retaining ring 120 includes a body 121 and one or more protrusions 122, cut out from the body 121, that extend upward at a slightly acute angle relative to the rest of the body 121. The body 121 is coupled to the middle portion 163 of the electrical contact 100 using one or more fastening device 123 (in this case, rivets). The protrusions 122 are configured (in this case, facing the conductor receiver end 161) in such a way as to prevent the electrical contact 100 from being pulled back out of the connector sleeve 230. The middle portion 163 also includes a wall 119 disposed within the middle portion 163. The wall 119 can form the cavity 102 and acts as a transition between the transitional inner surface 108 of the conductor receiver end 161 and the transitional inner surface 109 of the connector end 162.

The connector sleeve 230 of the electrical connector 200 receives the electrical contact 100. In other words, a user forces the electrical contact 100 inside the cavity 231 of the connector sleeve 230. The connector sleeve 230 is defined by a proximal end 234, a distal end 235, one or more outer surfaces (e.g., outer surface 233, outer surface 241, outer surface 242), and one or more inner surfaces (e.g., inner surface 232, inner surface 236, inner surface 237). The connector sleeve 230 is made of one or more electrically non-conductive materials (e.g., rubber, plastic).

The connector sleeve 230 is substantially tubular with a shape, when viewed from an end, that is substantially circular. In particular, the characteristics (e.g., shape, size) of the inner surfaces of the connector sleeve 230 are substantially the same as, or slightly larger than, the corresponding characteristics of the outer surfaces (not counting the drive pins 110) of the electrical contact 100. In other words, as shown in FIG. 2, because of the drive pins 110 protruding from the outer surface of the electrical contact 100, the diameter formed by the heads 112 of the drive pins 110 are larger than the diameter formed by the inner surface 237 of the connector sleeve 230.

Consequently, a tremendous amount of force must be applied to the electrical contact 100 in order to position the electrical contact 100 within the cavity 231 of the connector sleeve 230. Because of the relatively small size and shape of the connector sleeve 230 and the electrical contact 100, this process of forcing the electrical contact 100 within the cavity 231 of the connector sleeve 230 can be time-consuming, difficult to complete, and has a high risk of causing damage to the connector sleeve 230 and/or the electrical contact 100. As a result, example embodiments, as described below, have been developed to ease the process of inserting the electrical contact 100 within the cavity 231 of the connector sleeve 230 in an efficient, easy, and safe manner that minimizes the risk of damaging the electrical contact 100 and/or the connector sleeve 230.

Figure 3A:
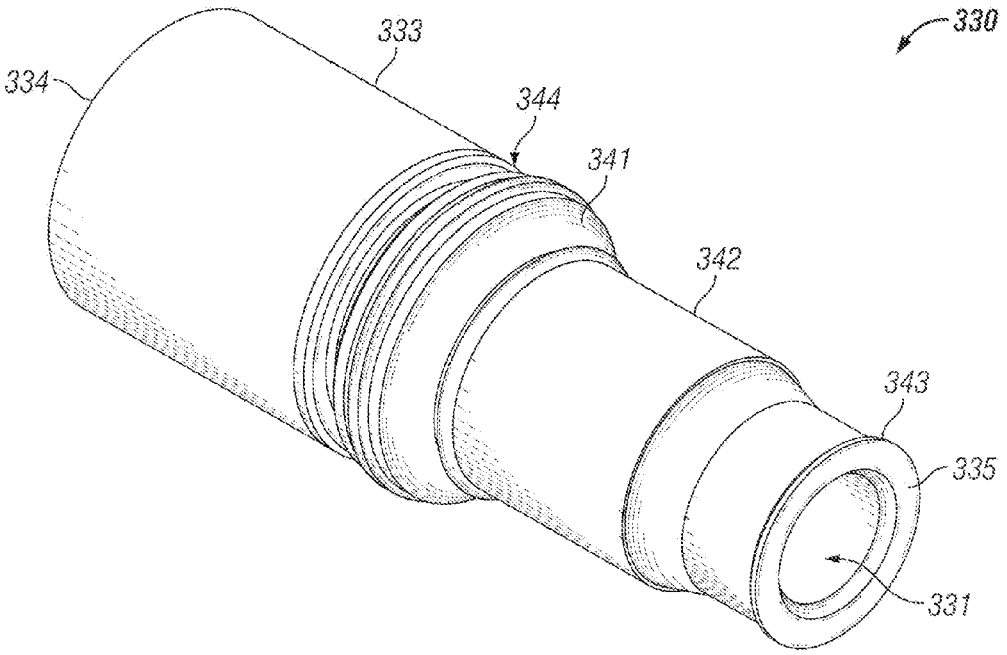
FIGS. 3A and 3B show various views of a sleeve of an electrical connector in accordance with certain example embodiments.
Figure 3B:
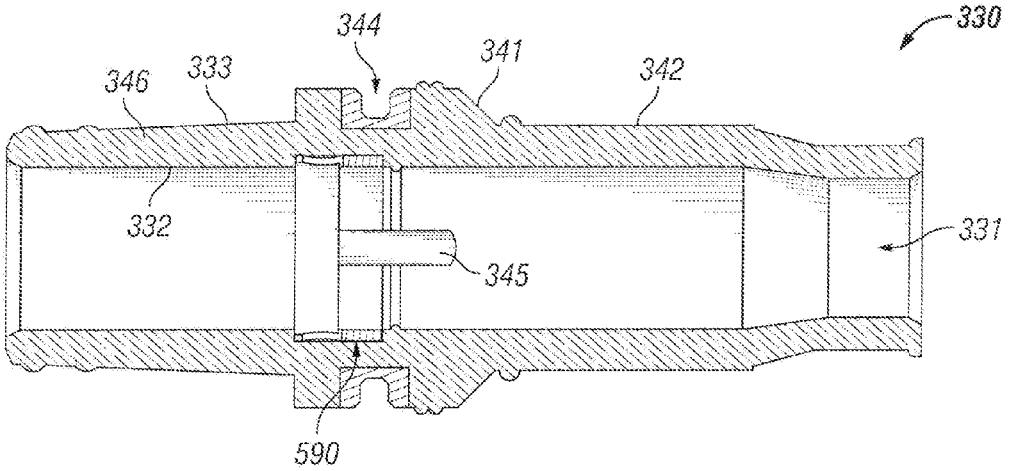

FIGS. 3A and 3B show a connector sleeve 330 in accordance with certain example embodiments. In one or more example embodiments, one or more of the components shown in FIGS. 3A and 3B may be omitted, repeated, and/or substituted. Accordingly, example embodiments of connector sleeves should not be considered limited to the specific arrangement shown in FIGS. 3A and 3B.

The connector sleeve 330 of FIGS. 3A and 3B is substantially the same as the connector sleeve 230 of FIG. 2, except as described below. Referring to FIGS. 1-3B, the connector sleeve 330 can include a locking ring 590 disposed within the cavity 331 on an inner surface 332 of the wall 346. The locking ring 590 can be used to limit the distance that an electrical contact (e.g., electrical contact 400 of FIGS. 4A-4D, described below) can be inserted into the cavity 221 of the connector sleeve 330. An example of a locking ring 590 is provided with respect to FIG. 5B below.

In certain example embodiments, the connector sleeve 330 includes one or more slotted recesses 345 disposed along the inner surface 332 of the wall 346. In such a case, the slotted recess 345 can be positioned adjacent to the locking ring 590. The slotted recess 345 can be used to orient the electrical contact 400 within the cavity 331 of the connector sleeve 330. Specifically, the slotted recess 345 can have characteristics (e.g., a width) that allow a drive pin of the electrical contact 400 to be slidably disposed within the slotted recess 345 as the electrical contact 400 is pushed further into the cavity 331 of the connector sleeve 330. The number of slotted recesses 345 can be the same as, or different than, the number of drive pins. If there are multiple slotted recesses 345 and multiple drive pins, then the spacing of the slotted recesses 345 along the inner surface 332 of the wall 346 can be substantially the same as the spacing of the drive pins along the outer surface of the electrical contact 400.

The connector sleeve 330 can also include one or more additional features. For example, as shown in FIGS. 3A and 3B, the connector sleeve 330 can have a coupling feature 344 disposed on the outer surface (in this case, between outer surface 333 and outer surface 341) of the connector sleeve 330. In this case, the coupling feature 344 is a slot that is disposed around the entire perimeter of the connector sleeve 330. In such a case, the coupling feature 344 can be inserted into a bracket, disposed in an aperture in an enclosure, or coupled to some other feature of some component of an electrical system. In such a case, the connector sleeve 330 can be held in a particular position and/or at a particular location.

FIGS. 4A-4D show an electrical contact 400 in accordance with certain example embodiments. In one or more example embodiments, one or more of the components shown in FIGS. 4A-4D may be omitted, repeated, and/or substituted. Accordingly, example embodiments of electrical contacts should not be considered limited to the specific arrangement shown in FIGS. 4A-4D.

The electrical contact 400 of FIGS. 4A-4D is substantially the same as the electrical contact 100 of FIG. 1, except as described below. Referring to FIGS. 1-4D, the electrical contact 400 can include a drive pin assembly 410. In such a case, the drive pin assembly 410 can include one or more drive pins (e.g., drive pin 470, drive pin 480) that are each retractable. In other words, the middle portion 463 has at least one recessed area 417 (also called a channel 417) adjacent to the outer surface 405 of the middle portion 463 and another recessed area 416 (also called a channel 416) adjacent to the recessed area 417.

The recessed area 417 can have a shape (e.g., cylindrical) and size (e.g., height, width, diameter) that is substantially the same, or slightly larger than, the shape and size of the head (e.g., head 472, head 482) of a drive pin (e.g., drive pin 470, drive pin 480). Similarly, the recessed area 416 can have a shape and size that is substantially the same, or slightly larger than, the shape and size of the shaft (e.g., shaft 471, shaft 481) of a drive pin (e.g., drive pin 470, drive pin 480). In certain example embodiments, the recessed area 416 and the recessed area 417, when combined, can traverse the entire middle portion 463 of the electrical contact 400.

Since the drive pins (e.g., drive pin 470, drive pin 480) of the drive pin assembly 410 are movable, each drive pin can have a normal position and a retracted position. When the drive pins are in the retracted position, as shown, for example, in FIG. 4C, the drive pins are disposed within the recessed areas of the body. For example, when the drive pin 470 is in the retracted position, the head 472 is disposed (at least in part) in the recessed area 417, and the shaft 471 is disposed (at least in part) in the recessed area 416. Similarly, when the drive pin 480 is in the retracted position, the head 482 is disposed (at least in part) in the recessed area 417, and the shaft 481 is disposed (at least in part) in the recessed area 416.

Figure 4A:
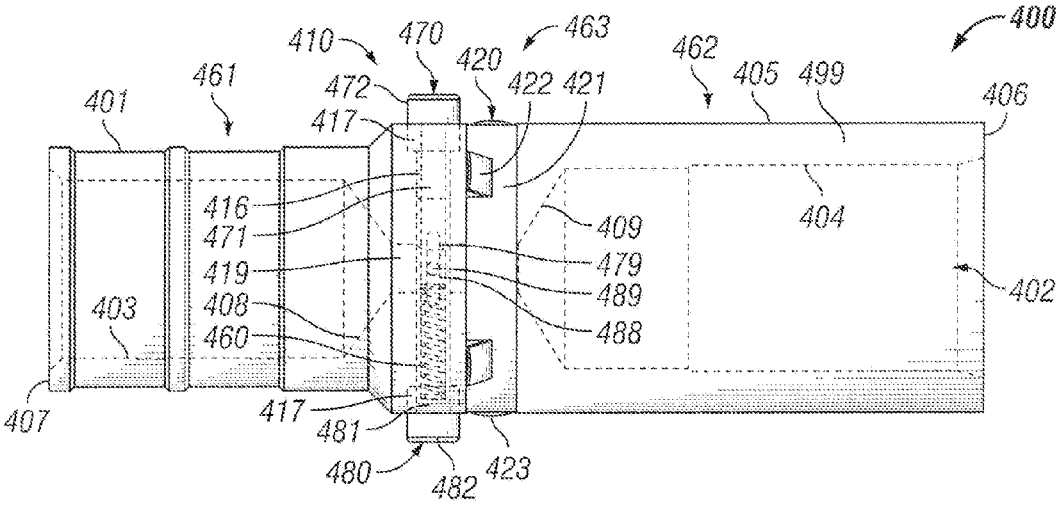
FIGS. 4A-4D show various views of a contact of an electrical connector in accordance with certain example embodiments.
Figure 4B:
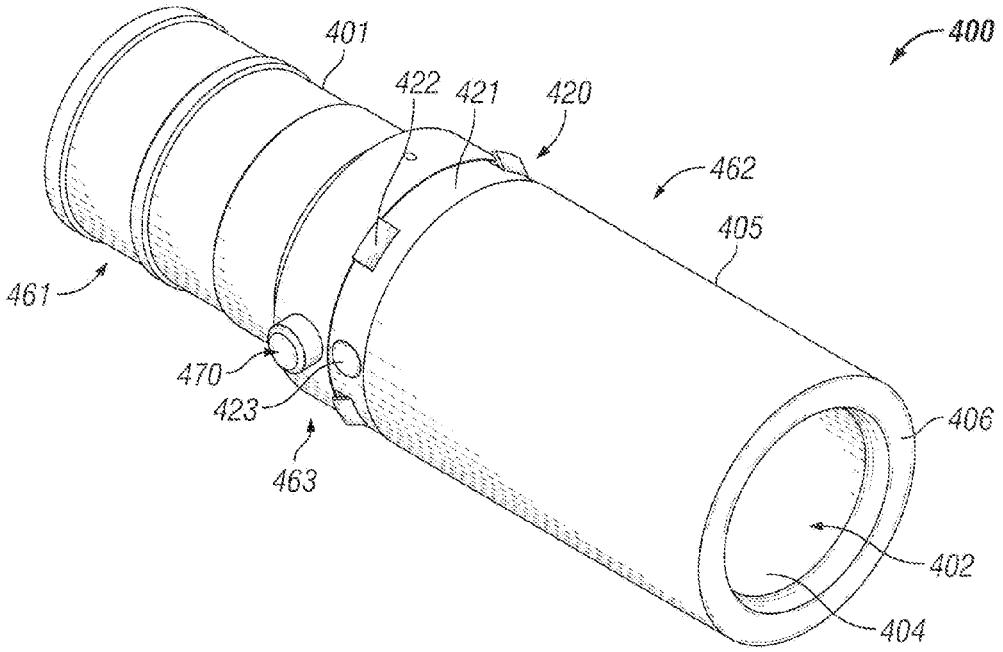
Figure 4C:
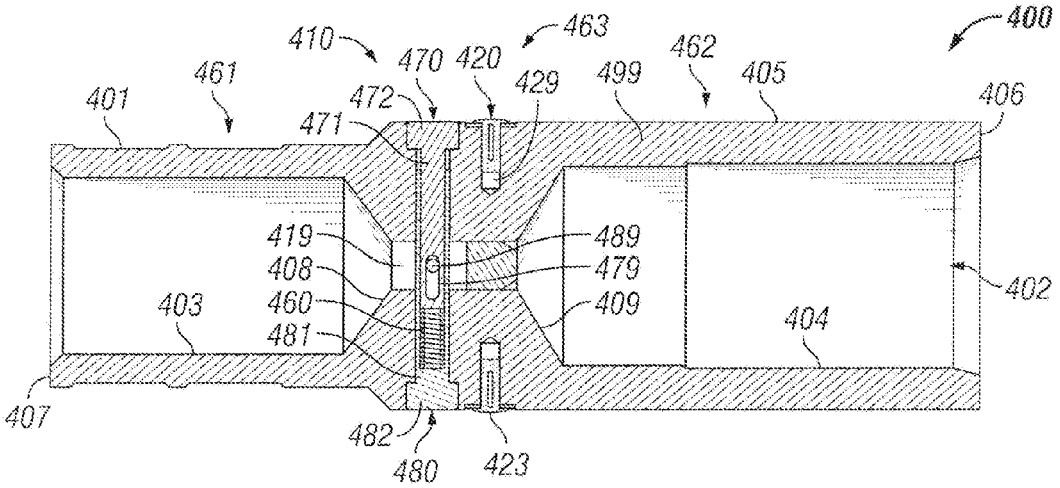
Figure 4D:
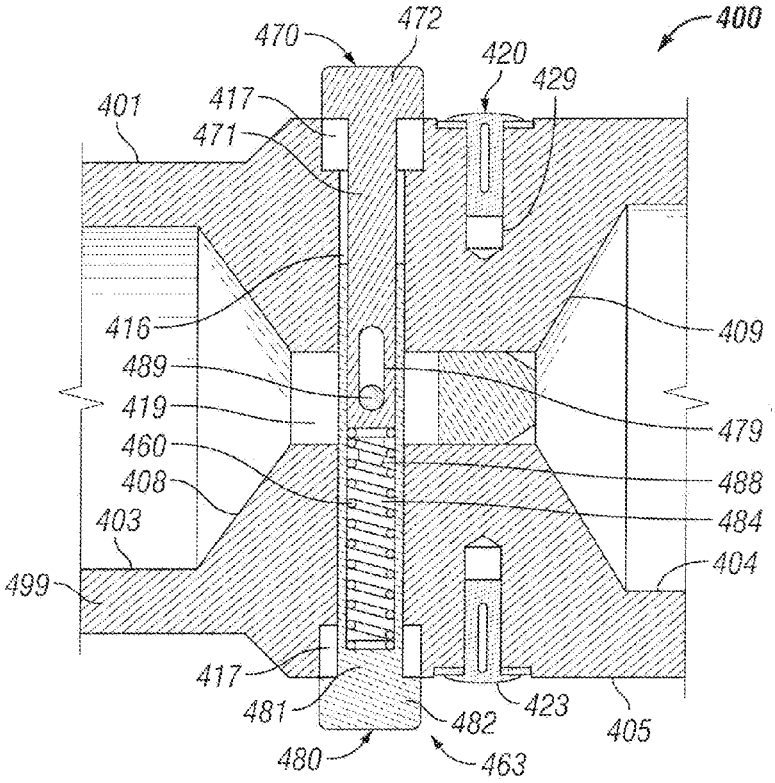

Conversely, when the drive pins are in the normal position, as shown, for example, in FIGS. 4A, 4B, and 4D, the drive pins protrude from the outer surface 405 of the body of the electrical contact 400. For example, when the drive pin 470 is in the normal position, the head 472 protrudes (at least in part) above the recessed area 417 and the outer surface 405, and the top portion of the shaft 471 can be disposed (at least in part) in the recessed area 417. Similarly, when the drive pin 480 is in the normal position, the head 482 protrudes (at least in part) above the recessed area 417 and the outer surface 405, and the shaft 481 can be disposed (at least in part) in the recessed area 417.

In certain example embodiments, the drive pins of the drive pin assembly 410 are put in the retracted position as the body of the electrical contact 400 is inserted into the connector sleeve 330. Once the electrical contact 400 is properly positioned within the connector sleeve 330, the drive pins of the drive pin assembly 410 revert to the normal position, helping to secure the electrical contact 400 within the cavity 331 of the connector sleeve 330.

The drive pin assembly 410 can include one drive pin or multiple pins. For example, as shown in FIGS. 4A-4D, there can be two drive pins in the drive pin assembly 410. When there are multiple drive pins in the drive pin assembly 410, the drive pins can be spaced in any way (e.g., equally, randomly) along the outer surface 405 of the body of the electrical contact 400. For example, as shown in FIGS. 4A-4D, drive pin 470 and drive pin 480 are located substantially opposite each other along the body of the electrical contact 400. Further, when there are multiple drive pins in the drive pin assembly 410, at least one drive pin can be retractable and at least one drive pin can be fixed (as the drive pins 110 of FIGS. 1 and 2).

In certain example embodiments, when there are multiple drive pins of the drive pin assembly 410, the drive pins can interact with each other when moving between the normal and retracted positions. For example, as shown in FIGS. 4B-4D, when there are two drive pins (drive pin 470 and drive pin 480), one of the drive pins (in this case, drive pin 480) can have a shaft 481 with a pin cavity 484 disposed within the shaft 481, and the shaft 471 of the other drive pin (in this case, drive pin 470) can be movably disposed within the pin cavity 484 of the shaft 481.

In certain example embodiments, when the drive pins can interact with each other when moving between the normal and retracted positions, one or more of the drive pins can have one or more travel limit features that limit the distance that one or more of the drive pins of the drive pin assembly 410 can travel toward the retracted position and/or toward the normal position. With or without travel limit features, multiple drive pins in a drive pin assembly 410 can complement each other (e.g., when one drive pin 470 changes from a retracted position to a normal position, another drive pin 480 also changes from a retracted position to a normal position) or work independently of each other (e.g., one drive pin 480 can change from a normal position to a retracted position while another drive pin 470 remains in the normal position).

As an example, as shown in FIGS. 4B-4D, the drive pin 470 can have a slot 479 that traverses the shaft 471 toward the distal end of the shaft 471. In addition, the drive pin 480 can have a pin 489 coupled to part of the shaft 471, where the pin is disposed within the slot 479. In this way, the pin 489 abuts against a distal end of the slot 479 when the drive pins are in the normal position (as shown, for example, in FIG. 4D), preventing the drive pins from extending farther away from the outer surface 405 of the body of the electrical contact 400. Similarly, the pin 489 abuts against a proximal end of the slot 479 when the drive pins are in the retracted position (as shown, for example, in FIG. 4C), preventing the drive pins from retracting further inside the body of the electrical contact 400. In certain example embodiments, the pin 489 is used to keep the rest of the drive pin assembly 410 (specifically, the drive pin 470 and the drive pin 480) movably coupled to each other.

Alternatively, the pin 489 can be held in a fixed position within the body of the electrical device 400. Also, in addition to the slot 479 in the shaft 471 of the drive pin 470, another slot 488 (as shown in FIG. 4D) can be disposed in and traverse the shaft 481 of the drive pin 480. In this way, the pin 489 can abut against the distal end of the slot 479 and the slot 488 when the drive pin 470 and the drive pin 480, respectively, are in the normal position, as shown in FIGS. 4A and 4D. Similarly, the pin 489 can abut against the proximal end of the slot 479 and the slot 488 when the drive pin 470 and the drive pin 480, respectively, are in the retracted position, as shown in FIG. 4C.

Another example of travel limit features can be the size of the head (e.g., head 482) relative to the size of the shaft (e.g., shaft 481) of a drive pin (e.g., drive pin 480) incorporated with the size of the channel 417 relative to the size of the channel 416 in the body of the electrical contact 400. Specifically, as shown in FIGS. 4B-4D, the outer perimeter (e.g., diameter) of the head is larger than the outer perimeter of the shaft and the outer perimeter of the channel 416 into which the shaft is disposed. Thus, once the bottom of the head abuts against the bottom of the channel 417, as shown in FIG. 4C, the drive pin is in the retracted position and is prevented from traveling further into the body of the electrical contact 400.

In some cases, additional objects can be used to move the drive pins between the retracted position and the normal position. For example, as shown in FIGS. 4B-4D, a resilient device 460 (e.g., a spring) can be disposed within the pin cavity 484 within the shaft 481 of the drive pin 480. In such a case, the resilient device 460 can apply a force against the distal end of the shaft 471 of the drive pin 470 and against the portion of the shaft 481 of the drive pin 480 that borders the top of the pin cavity 484. When this force is applied by the resilient device 460, the drive pin 470 and the drive pin 480 are pushed toward the normal position and away from the retracted position.

In certain example embodiments, electrical continuity is maintained between the conductor receiver end 461 and the connector end 462 through the middle portion 463. This electrical continuity is maintained regardless of the configuration and/or location of the drive pin array 410, including any features (e.g., travel limit features) or other devices (e.g., resilient devices) that are incorporated into the drive pin assembly 410.

As described herein, the middle portion 463 is merely meant to describe a portion of the electrical contact 400 where the drive pin assembly 410 is disposed. Therefore, the term "middle" as used herein is not meant to limit the location of the drive pin assembly 410 as being in the approximate middle along the length of the electrical contact 400, or even in between the conductor receiver end 461 and the connector end 462. In other words, the drive pin assembly 410 can be disposed within the conductor receiver end 461, the connector end 462, and/or any other portion of the electrical contact 400.

Similarly, as shown in FIGS. 4A-4D, the retaining ring 420 can be located adjacent to the drive pin assembly 410 in the middle portion 463 of the electrical contact 400. Alternatively, the retaining ring 420 can be disposed on the conductor receiver end 461, the connector end 462, and/or any other portion of the electrical contact 400. In addition, or in the alternative, the retaining ring 420 can be disposed at some location on the electrical contact 400 that is not adjacent to the drive pin assembly 410. The electrical contact 400 can have more than one retaining ring 420. The fastening devices 423 used to couple the retaining ring 420 to the electrical contact 400 can be disposed within some or all of a recess 429 in the electrical contact 400.

Figure 5A:
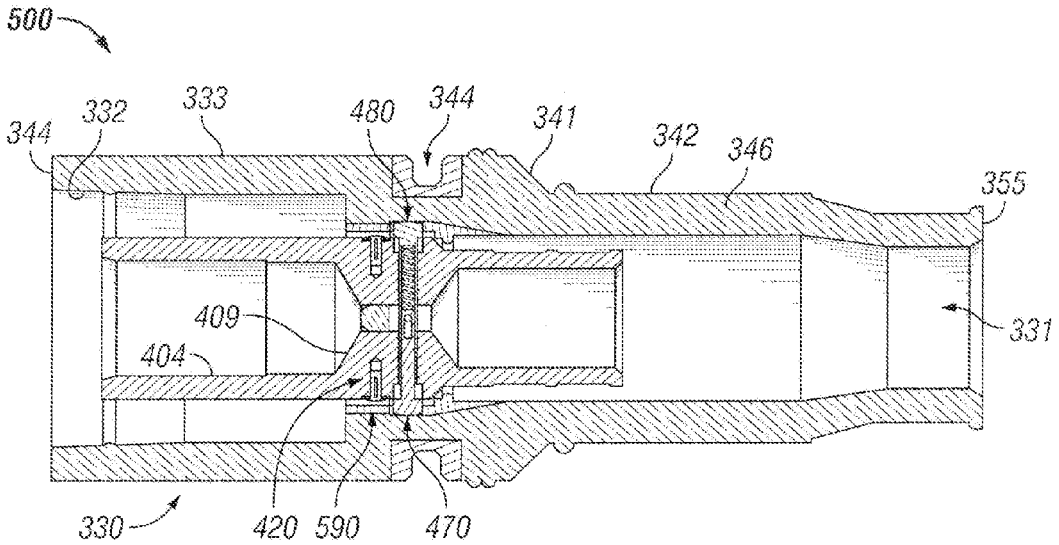
FIGS. 5A and 5B show various views of an electrical connector in accordance with certain example embodiments.
Figure 5B:
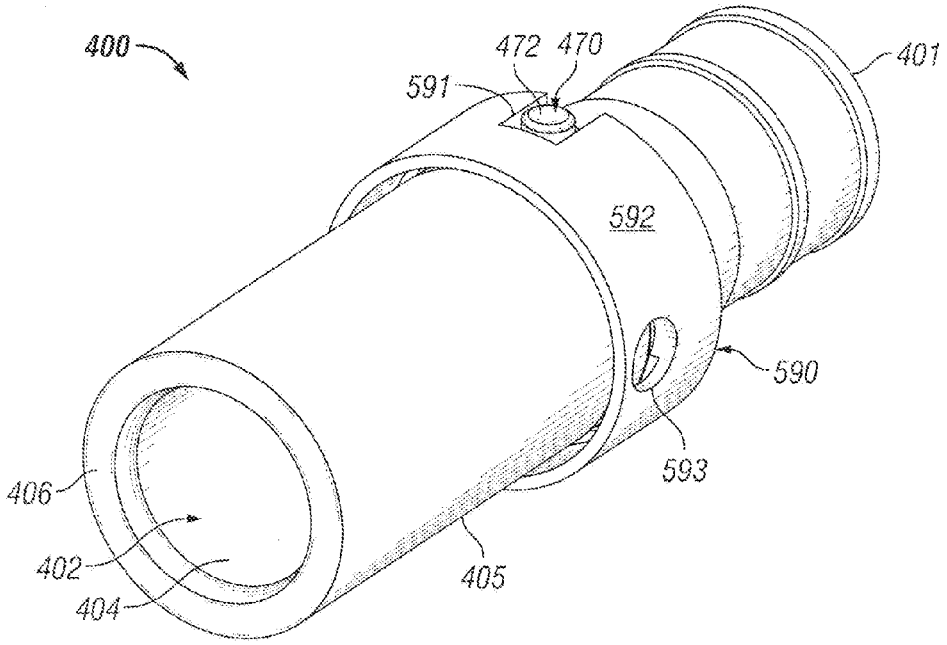

FIGS. 5A and 5B show various views of an electrical connector 500 in accordance with certain example embodiments. In this case, the electrical connector 500 includes the electrical contact 400 of FIGS. 4A-4D and the connector sleeve 330 of FIGS. 3A and 3B. FIG. 5A shows a cross-sectional side view of the electrical connector 500, and FIG. 5B shows a perspective view of the electrical contact 400 and the locking ring 590.

In one or more example embodiments, one or more of the components shown in FIGS. 5A and 5B may be omitted, repeated, and/or substituted. Accordingly, example embodiments of electrical connectors (or portions thereof) should not be considered limited to the specific arrangement of components shown in FIGS. 5A and 5B. Further, labels not shown in FIGS. 5A and 5B but referred to with respect to FIGS. 5A and 5B can be incorporated by reference from FIGS. 3A-4D. Similarly, a description of a label shown in FIGS. 5A and 5B but not described with respect to FIGS. 5A and 5B can use the description from FIGS. 3A-4D.

Referring to FIGS. 1-5B, the electrical connector 500 in FIG. 5A shows the electrical contact 400 being inserted into the connector sleeve 330. Specifically, in this case, the connector end 462 of the body of the electrical contact 400 is inserted into the cavity 331 of the connector sleeve 330 before the middle portion 463 and the conductor receiver end 461 is inserted into the cavity 331 of the connector sleeve 330.

The drive pin 470 and the drive pin 480 are in the refracted position as they approach the locking ring 590 within the cavity 331 of the connector sleeve 330. When the electrical contact 400 is inserted into the connector sleeve 330 to the point where the drive pins have reached the locking ring 590, the drive pin 470 and the drive pin 480 are both in the normal position, as shown in FIG. 5B.

The locking ring 590 can have one or more of a number of features. For example, as shown in FIG. 5B, the locking ring 590 can have a body 592 into which one or more slots 591 are disposed. In addition, or in the alternative, the body 592 can have one or more apertures 593 disposed therethrough. The slots 591 and the apertures 593 can have a shape and size that is suitable for the head (e.g., head 472) of a drive pin (e.g., drive pin 470) to be disposed therein when the drive pin is in the normal position. In this example, the head 472 of the drive pin 470 is disposed in the slot 591 when the drive pin is in the normal position.

In certain example embodiments, a drive pin (e.g., drive pin 470) reverts to the normal position from the retracted position when the drive pin abuts against a feature (e.g., the slot 591) in the locking ring 590. The drive pin can be allowed to revert from the retracted position to the normal position based on one or more of a number of features of the electrical connector 500. For example, the slope of a slotted recess 345 disposed along the inner surface 332 of the wall 346 of the connector sleeve 330 can allow the drive pin to revert to the normal position from the retracted position as the slotted recess 345 guides the drive pin toward the slot 591 in the locking ring 590. In the case of the example shown in FIG. 5A, the slot 591 in the locking ring 590 prevents the drive pin 470 (and so the entire electrical contact 400) from moving farther to the left within the cavity 331 of the connector sleeve 330.

As described above, the retaining ring 420, in this case disposed on the outer surface 405 of the connector end 462, is designed to prevent the electrical contact 400 from moving to the right within the cavity 331 of the connector sleeve 330. As long as the protrusions 422 make contact with an inner surface (e.g., inner surface 332) of the connector sleeve 330 adjacent to the protrusions 422, the protrusions 422 of the retaining ring 420 will prevent the electrical contact 400 from retracing its path (from being withdrawn) within the cavity 331 of the connector sleeve 330.

Figure 6A:
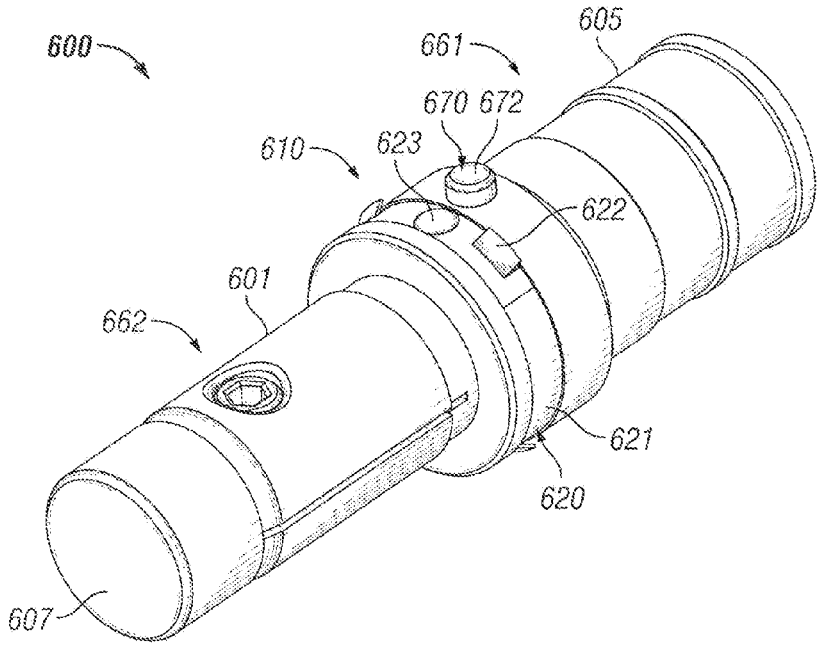
FIGS. 6A and 6B shows various views of an electrical contact in accordance with certain example embodiments.
Figure 6B:
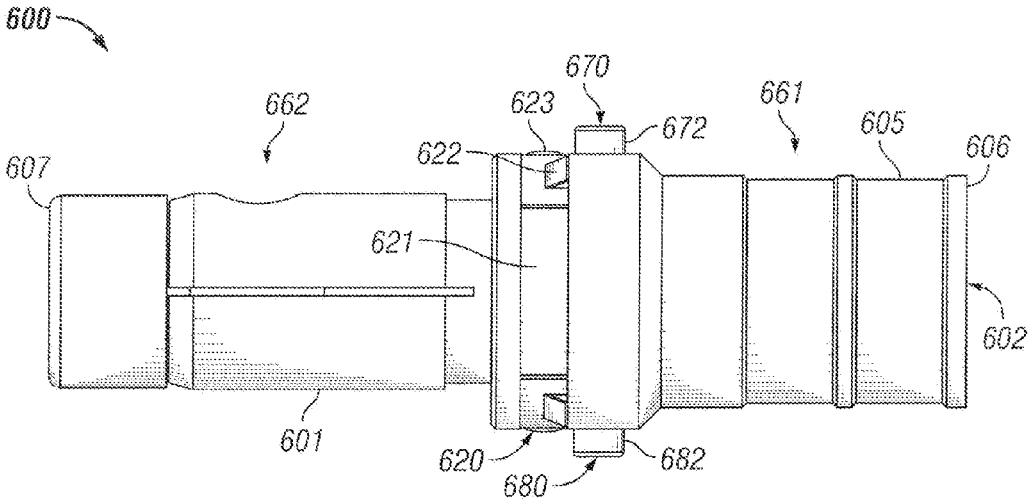

FIGS. 6A and 6B shows various views of an electrical contact 600 in accordance with certain example embodiments. Specifically, FIG. 6A shows a perspective view of the electrical contact 600, and FIG. 6B shows a side view of the electrical contact 600. In one or more example embodiments, one or more of the components shown in FIGS. 6A and 6B may be omitted, repeated, and/or substituted. Accordingly, example embodiments of electrical contacts (or portions thereof) should not be considered limited to the specific arrangement of components shown in FIGS. 6A and 6B. Further, labels not shown in FIGS. 6A and 6B but referred to with respect to FIGS. 6A and 6B can be incorporated by reference from FIGS. 3A-5B. Similarly, a description of a label shown in FIGS. 6A and 6B but not described with respect to FIGS. 6A and 6B can use the description from FIGS. 3A-5B.

Referring to FIGS. 1-6B, the electrical contact 600 in FIGS. 6A and 6B is substantially similar to the electrical contact 400 of FIGS. 4A-5B, except that the connector end 662 of the electrical contact 600 has a male configuration (instead of the female configuration of the connector end 462 of the electrical contact 400). In other words, the connector end 662 of the electrical contact 600 is pin having no cavity that traverses along its entire length.

Example embodiments described herein allow an electrical connector to become assembled without risk of injury, risk of damage to the various components of the electrical connector, and in an efficient manner. Example embodiments can also be used in environments that require compliance with one or more standards and/or regulations.

Accordingly, many modifications and other embodiments set forth herein will come to mind to one skilled in the art to which example electrical connectors pertain having the benefit of the teachings presented in the foregoing descriptions and the associated drawings. Therefore, it is to be understood that example electrical connectors are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. An insertable electrical contact, comprising:

a body comprising a connector end, a conductor receiver end, and a middle portion disposed between the connector end and the conductor receiver end; and at least one retractable drive pin disposed in the body, wherein the at least one retractable drive pin has a normal position and a retracted position, wherein the at least one retractable drive pin is disposed within the body when in the retracted position, and wherein the at least one retractable drive pin protrudes from an outer surface of the body when in the normal position, wherein the at least one retractable drive pin is in the retracted position as the body is inserted into a connector sleeve, wherein the at least one retractable drive pin permanently reverts to the normal position when the body is positioned within the connector sleeve, and wherein the at least one retractable drive pin is inaccessible when positioned within the connector sleeve.

2. The insertable electrical contact of claim 1, wherein the at least one retractable drive pin comprises a first retractable drive pin and a second retractable drive pin.

3. The insertable electrical contact of claim 2, wherein the first retractable drive pin and the second retractable drive pin are located substantially opposite each other along the body.

4. The insertable electrical contact of claim 2, wherein the first retractable drive pin comprises a shaft having a pin cavity disposed therein, and wherein the second retractable drive pin is movably disposed within the pin cavity.

5. The insertable electrical contact of claim 4, wherein the first retractable drive pin further comprises a resilient device disposed within the pin cavity, wherein the resilient device applies a force that pushes the first retractable drive pin and the second retractable drive pin toward the normal position.

6. The insertable electrical contact of claim 5, wherein the first retractable drive pin further comprises a travel limit feature, wherein the second retractable drive pin comprises a complementary travel limit feature, wherein the travel limit feature and the complementary travel limit feature prevent the first retractable drive pin and the second retractable drive pin from extending beyond the normal position.

7. The insertable electrical contact of claim 6, wherein the complementary travel limit feature comprises a slot, and wherein the travel limit feature comprises a pin that is slidably disposed within the slot.

8. The insertable electrical contact of claim 7, wherein the first retractable drive pin moves independently of the second retractable drive pin.

9. The insertable electrical contact of claim 1, wherein the middle portion of the body comprises at least one channel into which the at least one retractable drive pin is movably disposed.

10. The insertable electrical contact of claim 9, wherein the at least one channel has a substantially similar shape and size as the at least one retractable drive pin when the at least one retractable drive pin is in the retracted position.

11. The insertable electrical contact of claim 10, wherein the at least one retractable drive pin comprises a head that has a larger outer perimeter than a remainder of the at least one retractable drive pin.

12. The insertable electrical contact of claim 1, wherein electrical continuity is maintained between the connector end and the conductor receiver end through the middle portion.

13. An electrical connector, comprising:

a connector sleeve comprising a wall that forms a cavity; and an insertable electrical contact forced into the cavity of the connector sleeve, wherein the insertable electrical contact comprises:

a body comprising a connector end, a conductor receiver end, and a middle portion disposed between the connector end and the conductor receiver end; and at least one retractable drive pin disposed in the body, wherein the at least one retractable drive pin has a normal position and a retracted position, wherein the at least one retractable drive pin is disposed within the body when in the retracted position, and wherein the at least one retractable drive pin protrudes from an outer surface of the body when in the normal position, wherein the at least one retractable drive pin is in the retracted position as the body is inserted into the cavity of the connector sleeve, wherein the at least one retractable drive pin permanently reverts to the normal position when the body is positioned within the cavity of the connector sleeve, and wherein the at least one retractable drive pin is inaccessible when the body of the insertable electrical contact is positioned within the cavity of the connector sleeve.

14. The electrical connector of claim 13, wherein the connector sleeve further comprises a locking ring disposed within the cavity on an inner surface of the wall, wherein the locking ring limits a distance that the insertable electrical contact can be inserted into the cavity of the connector sleeve.

15. The electrical connector of claim 14, wherein the at least one retractable drive pin reverts to the normal position when the at least one retractable drive pin abuts against the locking ring.

16. The electrical connector of claim 15, wherein the connector sleeve further comprises a slotted recess disposed along an inner surface of the wall, wherein the slotted recess is adjacent to the locking ring, and wherein the slotted recess orients the insertable electrical contact within the cavity of the connector sleeve.

17. The electrical connector of claim 13, wherein the connector end of the body of the insertable electrical contact is inserted into the cavity of the connector sleeve before the middle portion and the conductor receiver end of the body is inserted into the cavity of the connector sleeve.

18. The electrical connector of claim 17, wherein the insertable electrical contact further comprises a retaining ring disposed on an outer surface of the conductor receiver end, wherein the retaining ring prevents the insertable electrical contact from being withdrawn from the cavity of the connector sleeve.

19. The electrical connector of claim 13, further comprising:

an electrical conductor disposed within the conductor receiver end of the body when the at least one retractable drive pin is in the normal position within the cavity of the connector body.

20. The electrical connector of claim 19, wherein the conductor receiver end of the body is coupled to the electrical conductor using a crimping tool applied to the conductor receiver end before the insertable electrical contact is inserted into the cavity of the connector sleeve.

* * * * *